US005549180A

United States Patent [19]

Hansen

[11] Patent Number: 5,549,180

[45] Date of Patent: Aug. 27, 1996

[54] EMERGENCY ESCAPE APPARATUS

[75] Inventor: C. Calvin Hansen, Manhattan, Kans.

[73] Assignee: C. Calvin Hansen Trust U/A, Manhattan, Kans.

[21] Appl. No.: 406,513

[22] Filed: Mar. 17, 1995

[51] Int. Cl.[6] ..... B66B 5/00

[52] U.S. Cl. ..... 187/347; 187/406

[58] Field of Search ..... 187/347, 346, 187/345, 239, 351, 406, 409; 182/82, 233

[56] References Cited

U.S. PATENT DOCUMENTS

| | | | |
|---|---|---|---|
| 635,679 | 10/1899 | Forbes | 187/287 |
| 780,249 | 1/1905 | Withey | 182/82 |
| 912,560 | 2/1909 | Groom | 187/347 |
| 1,078,998 | 11/1913 | Ernst | 187/409 |
| 2,222,685 | 11/1940 | Raymond | 187/406 |
| 2,646,964 | 7/1953 | Andrews | 254/160 |
| 3,261,590 | 7/1966 | Bech et al. | 254/160 |
| 4,488,621 | 12/1984 | Schiewe | 187/70 |

*Primary Examiner*—Kenneth Noland
*Attorney, Agent, or Firm*—Litman, McMahon and Brown, L.L.C.

[57] ABSTRACT

An escape apparatus is designed for placement adjacent to an exterior entrance of a multi-story residence or other building. The escape apparatus includes an escape platform and cage which is attached to and supported by a sleeve which extends around the periphery of a vertically oriented stationary hollow column. The sleeve is movable upward and downward along the column exterior. A pair of cables are connected to the sleeve and extend from the sleeve upward and over a respective pair of sheaves positioned atop the vertical column and then into the column interior where they are connected to a speed control piston-counterweight. The column is preferably filled with liquid, such as a water and anti-freeze mixture, and the piston-counterweight has an aperture extending therethrough from top to bottom to allow liquid to flow from one side of the piston-counterweight to the other and a valve operating within the aperture to further regulate the rate of ascent of the piston-counterweight. The piston-counterweight more than offsets the empty weight of the escape platform, cage and sleeve so that the escape platform is automatically returned from the bottom of the column to an elevated position atop the column after it is emptied.

23 Claims, 3 Drawing Sheets

Fig. 1.
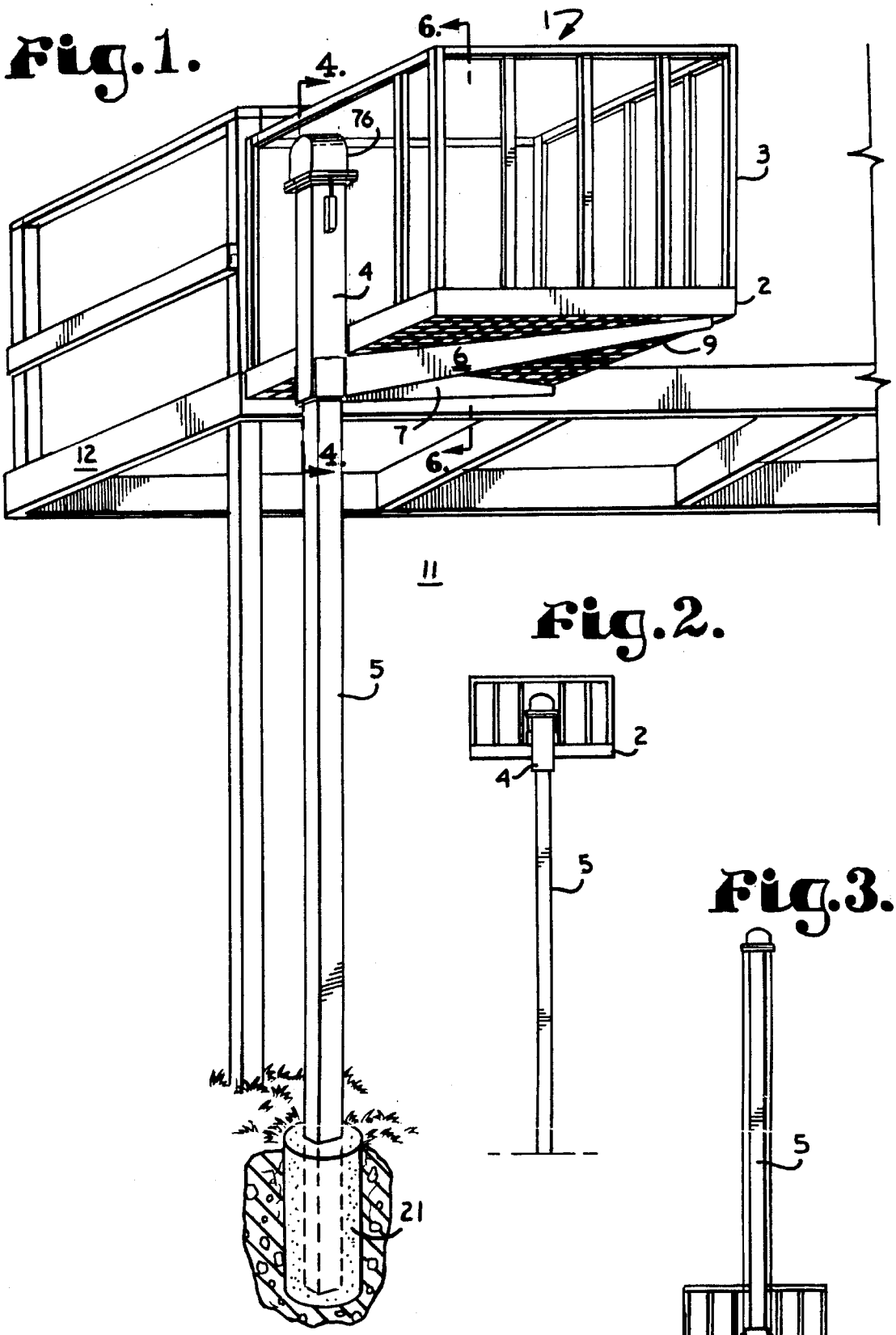
Fig. 2.
Fig. 3.
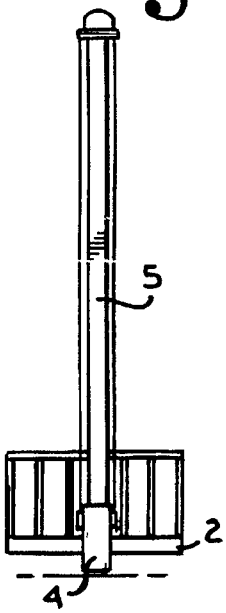

EMERGENCY ESCAPE APPARATUS

BACKGROUND OF THE INVENTION

1. Field of the Invention

This invention is directed to an emergency escape apparatus for allowing wheelchair bound or other physically handicapped persons, elderly people or children to safely escape a multi-story residence. The apparatus is supported and guided by a vertically oriented hollow column which also serves as a container for a counterweight and speed control system.

2. Description of the Related Art

The threat of fire to occupants of a multi-story home is always a concern. Recent improvements and advances in smoke and fire detectors can now reliably provide early warnings of fire and smoke. For able-bodied adults, these warnings, as well as prior planning and escape apparatus such as rope ladders, etc. have greatly improved the prospects for escape from a burning structure. However, for the elderly, young children, the physically handicapped or wheelchair bound residents, even an early warning does not always help in escape when there are stairs or other obstacles to negotiate.

One solution is the incorporation of a conventional electrically powered elevator within or outside the structure. The problems with this approach are many. The initial cost, which can be upwards of $20,000, is prohibitive for most people. Interior elevators also take up considerable space on two floors within the structure, and, during a fire, any electrically powered elevator can experience electrical problems or shutdowns which render it virtually useless.

A number of escape apparatus have been designed which rely on gravity to effect a descent with braking action provided by damping or the like. In one such unit, described in U.S. Pat. No. 2,646,964 to Andrews, an escape unit (not shown) is attached to a descent cable wound on a reel. A vertical column supports a take-up reel to which is attached a return cable with a weight attached to the bottom. The weight moves within a column of liquid, such as oil, and includes holes which perform a valving action so that the descent rate of the escape unit is controlled by the flow rate of the oil through the holes in the weight. The escape unit is apparently supported solely by the descent cable and appears to be designed for use by able-bodied individuals since it refers to attachment to a window.

In U.S. Pat. No. 4,488,621 to Schiewe, an escape cage is slidably attached to vertically oriented tracks affixed to the side of a building. A vertically disposed cylinder is positioned between the tracks and a piston-counterweight attached to a cable moves up and down within the cylinder as the cage moves up and down on the tracks. The piston-counterweight has seals on either end to provide an air-tight seal against the cylinder walls. A complex valving arrangement permits a fluid, such as air, to be exhausted from the cylinder below the piston-counterweight and reintroduced into the cylinder above the piston-counterweight at a controlled rate to allow the descent rate of the cage to be regulated. Emergency brakes are provided in the event of a damping failure. Conceptually, the Schiewe device is designed to allow a handicapped individual to reliably escape from a multi-story structure. However, the complexity of the apparatus, including the multiple valves and interconnected lines, adds undue expense and maintenance problems. The requirement to attach rails directly to the building exterior to support the cage as it moves up and down limits the type of building to which it can be attached and detracts from the aesthetics of the system.

Therefore, a need still exists for a safe, reliable and effective escape apparatus for allowing elderly, wheelchair bound or otherwise physically handicapped residents or young children to safely exit a multi-story residence. Such an escape apparatus should preferably be self-supporting and self-contained, should require no outside power source for its operation, should be of relatively simple construction, should be inexpensive, and should be capable of installation without modifications to the residence itself. Furthermore, the escape apparatus should be designed for reliable operation in virtually any weather conditions.

SUMMARY OF THE INVENTION

In the practice of the present invention, an escape apparatus is designed for placement adjacent to an exterior entrance of a multi-story residence or other building. The apparatus includes an escape platform and cage which is attached to and supported by a sleeve which extends around the periphery of a vertically oriented stationary hollow column. The sleeve is movable upward and downward along the column. A pair of cables are connected to the sleeve and extend from the escape platform upward and over a pair of sheaves positioned atop the vertical column and then into the column interior where they are connected to a speed control piston-counterweight. The column is preferably filled with liquid, such as a water and anti-freeze mixture, and the piston-counterweight has an aperture extending therethrough from top to bottom to allow liquid to flow from one side of the piston-counterweight to the other. The cable pair is of a length which allows the piston-counterweight to be suspended just above the bottom of the column when the escape platform is positioned atop the column, and to be suspended just below the top of the column when the escape platform has descended to ground level. The aperture extending through the piston-counterweight is sized to allow liquid to flow through the piston-counterweight at a predetermined rate, thus providing a braking action to control the rate of descent of the escape platform along the column and a valve is positioned in the aperture to allow the rate of ascent of the escape platform to be approximately equal to the rate of descent. The piston-counterweight includes two teflon gaskets extending about the top and bottom periphery thereof to provide a seal between the piston-counterweight and the interior side walls of the column. A bottom coil spring is positioned within the column to cushion the impact of the piston-counterweight as it approaches the bottom of the column. A very resilient coil spring with a seal positioned on the bottom thereof is positioned near the top of the column on the inside such that, as the piston counterweight approaches the top of the column, the spring carried seal seals off the flow of liquid through the piston-counterweight, thus causing the piston-counterweight to act as a self adjusting shock absorber to thereby halt the ascent of the piston-counterweight through the column. The piston-counterweight is filled with lead such that it more than offsets the empty weight of the escape platform and cage so that the escape platform is automatically returned from the bottom of the column to an elevated position atop the column after it is emptied.

The support sleeve is approximately trapezoidal in shape when viewed in cross-section and positioned within the support sleeve are a pair of roller spools to provide rolling support for the sleeve as it moves up and down the column. The roller spools and the trapezoidal sleeve design allow the sleeve to freely descend or ascend over the support column even with an ice build-up of up to ½". A hand brake lever is connected to a brake pad such that the brake pad can selectively be brought into contact with the exterior surface of the column to permit the descent of the escape platform to be selectively halted or slowed by an occupant during emergencies, or if an occupant should desire, to slow the rate of descent. A latch arm is attached to the hand brake lever arm and is positioned to cooperate with a stationary latch near the top of the column to hold the escape platform in an elevated position. A sheave cap is provide which covers the sheaves and cable mounts on the escape platform for protection from the elements and for aesthetic enhancement.

OBJECTS AND ADVANTAGES OF THE INVENTION

The principle objects and advantages of the present invention include: to provide an improved escape apparatus; to provide such an escape apparatus which is self-supported and self-contained; to provide such an apparatus in which an escape platform and cage are supported solely by a sleeve which surrounds and which is vertically movable relative to a vertically oriented column; to provide such an apparatus which includes a pair of cables with one end of each cable attached to a speed control piston-counterweight within the column, then over a respective pair of sheaves with the other end of each cable attached to the sleeve; to provide such an apparatus in which the column is filled with a damping fluid which flows through an aperture extending from top to bottom of the piston-counterweight as the escape platform ascends or descends along the column; to provide such an apparatus with a one-way valve positioned within the piston-counterweight to allow the piston-counterweight to ascend through the column at a rate approximately equal to the rate at which it can descend; to provide such an apparatus in which a hand brake is provide for selective emergency control of the descent rate of the escape platform, the hand brake including a latch for latching the escape platform in an elevated position relative to the column; to provide such an apparatus in which the sleeve is carried by roller spools such that the sleeve can reliably move up and down the column exterior even with up to ½" of ice thereon; to provide such an apparatus in which the column is placed in the ground to a depth at which ground temperature acts to heat the damping fluid, thus acting to somewhat decrease any ice formation on the exterior of the column; to provide such an apparatus with a cap positioned over the sheaves and the top of the column for protection and aesthetic enhancement; and to provide such an apparatus which is reliable, durable, economical to manufacture, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of an escape apparatus in accordance with the present invention, with an escape platform anchored to a support sleeve, which is, in turn, supported by and movable relative to a single anchored column and with the escape apparatus positioned adjacent a second floor deck of a multi-story residence.

FIG. 2 is a reduced, side elevational view of the escape apparatus, with the apparatus platform in a raised position.

FIG. 3 is a reduced, side elevational view of the escape apparatus, with the apparatus platform in a lowered position.

DETAILED DESCRIPTION OF THE INVENTION

I. Introduction and Environment

Figure 4:
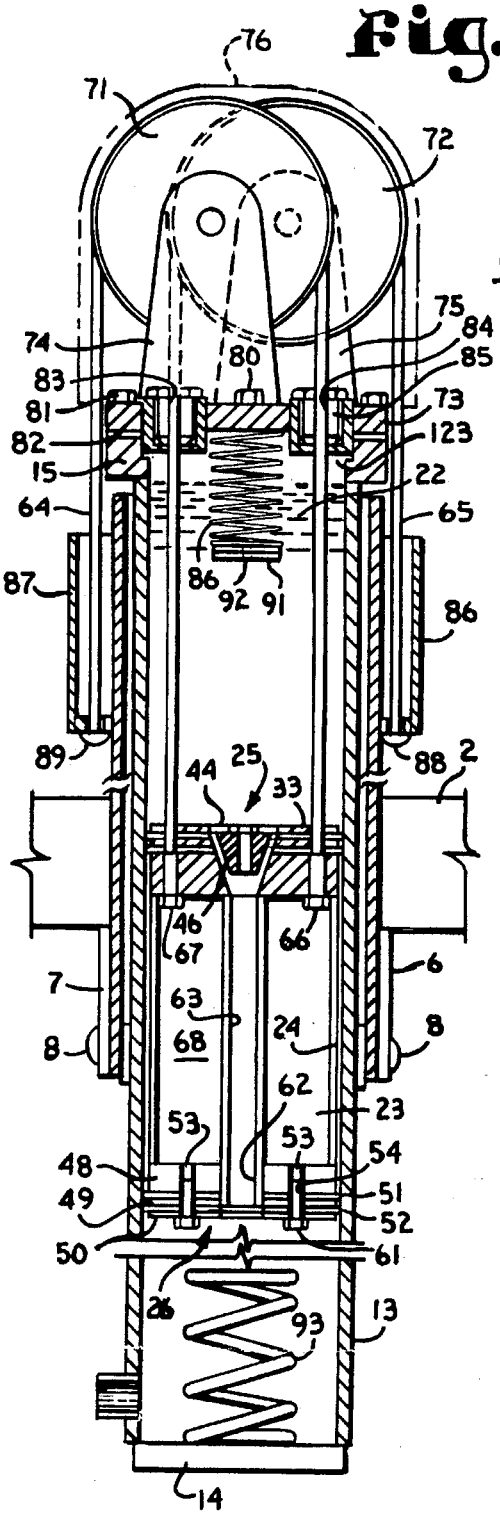
FIG. 4 is a fragmentary cross-sectional view of a support column and support sleeve, taken along line 4–4 of FIG. 1, and illustrating a piston-counterweight, a pair of support cables attached between the piston-counterweight and the sleeve with the cables extending over a pair of support sheaves, and with a one-way valve in the piston-counterweight in a descending, unseated and open position.
Figure 6:
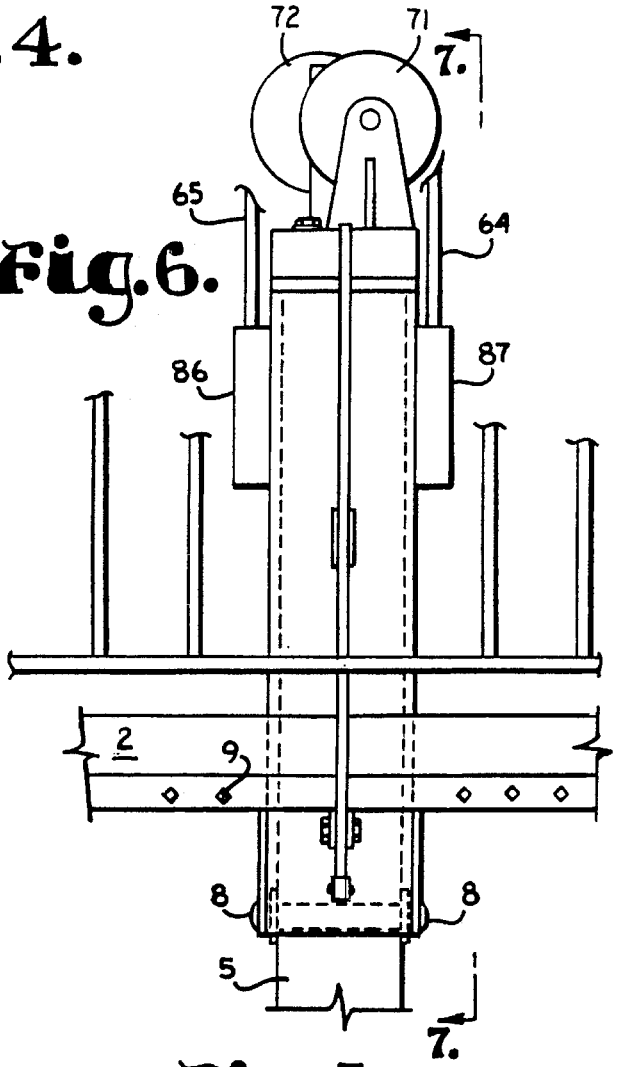
FIG. 6 is an enlarged, fragmentary cross sectional view of the escape apparatus, taken along the line 6—6 of FIG. 1, and illustrating a portion of the platform and cage attached to the sleeve.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

Referring to the drawings in more detail, FIG. 1 illustrates an emergency escape apparatus in accordance with the present invention, generally indicated as 1. The escape apparatus 1 includes an escape platform 2 with a surrounding safety cage 3. The escape platform 2 is supported by a support sleeve 4 surrounding a vertical column 5. The column 5 is illustrated as being rectangular in cross-section, but other shapes could serve equally well. A pair of support arms 6 and 7 radiate outward from the sleeve 4, with the support arms 6 and 7 attached beneath the escape platform 2, with the arms 6 and 7 being attached to the sleeve 4 via bolts 8. The escape platform 2 includes a grate 9 for a floor to prevent any accumulation of water, snow or ice thereon. The escape apparatus 1 is shown positioned adjacent to a multi-story structure 11 with a cantilevered deck 12 attached thereto. The escape platform 2, when the escape apparatus 1 is in the raised position, can be easily entered from the deck 12, even by a wheelchair bound or otherwise physically handicapped individual, an elderly person or a child.

Referring to FIGS. 1–6, the column 5 includes four sidewalls 13 which extend between and are attached to a bottom plate 14 and a top annular ring 15. The column 5 is supported by a foundation 21, preferably of poured, reinforced concrete. The column is filled with a liquid 22, such as a water and anti-freeze mixture. A piston-counterweight 23 is positioned within the column 5. The piston-counterweight 23 comprises a rectangular enclosure with sidewalls 24 connecting a top plate 25 and a bottom plate 26.

Figure 5:
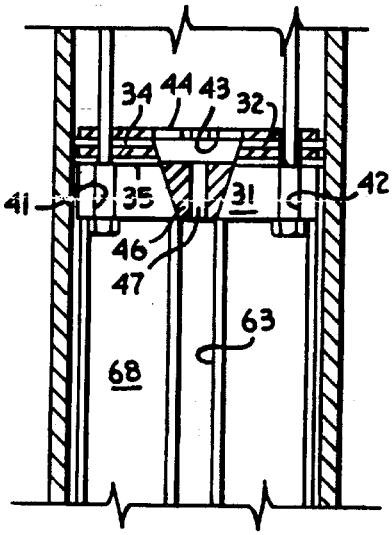
FIG. 5 is an enlarged, fragmentary view of a portion of the support column and escape platform section as in FIG. 4, but illustrating the piston-counterweight valve in an ascending, seated and partially closed position.

The top plate 25 of the piston-counterweight 23 includes three individual plates 31–33, with a pair of Teflon seals 34 and 35 sandwiched between respective pairs of the plates 31–33. Each of the plates 31–33 and the seals 34 and 35 include a pair of cable apertures 41 and 42 extending therethrough. The plates 31 and 32, as well as the seals 34 and 35 also have a central frustoconical recess 43 extending therethrough. Meanwhile, the plate 33 has a grated opening 44 which connects with the frustoconical recess 43. A movable frustoconical valve member 46 is positioned within the recess 43 beneath the plate 33, with the valve member 46 being freely movable between a floating, unseated and open position as shown in FIG. 4, and a bottom, seated and partially closed position in which it rests against the tapering sides of the recess 43, as shown in FIG. 5. The valve member 46 has a central aperture 47 extending from the top to the bottom thereof.

The bottom piston-counterweight plate 26 similarly comprises a somewhat thicker plate 48 and a pair of individual plates 49 and 50 with Teflon seals 51 and 52 sandwiched therebetween. The plate 48 includes a pair of threaded apertures 53 which match with apertures 54 extending through the other plates 49 as well as the seals 51. A pair of threaded bolts 61 attach the plates 48 and 49 and the seals 51 and 52 together. Each of the plates 48 and 49 and the seals 51 and 52 also includes a center aperture 62 which is aligned with the aperture 41 in the top plate 25, and with an elongate aperture 63 which extends the length of the piston-counterweight 23.

A pair of support cables 64 and 65 extend through the respective apertures 41 and 42 in the top piston-counterweight plate 25 and include respective heads 66 and 67 which engage the bottom surface of the plate 31. The piston-counterweight 23 is filled with lead 68, or another dense material such that the weight of the piston-counterweight more than offsets the empty weight of the escape platform 2 and the cage 3, as well as the support sleeve 4. For example, in one embodiment of the escape apparatus 1, the piston-counterweight 23 was 50–75 lbs. greater than the combined weight of the platform 2, cage 3 and sleeve 4.

The support cables 64 and 65, which can be plastic coated steel aircraft cables, for example, extend upward from respective sides of the piston-counterweight top plate 25 and over respective sheaves 71 and 72.

The sheaves 71 and 72 are connected to a column top plate 73 via a respective pair of supports 74 and 75, with the sheaves 71 and 72 being rotatable relative to the supports 74 and 75. A cap 76 covers the sheaves 71 and 72, as well as the top of the column 5, for weather protection as well as improved aesthetics. A top fill opening 80 is formed in the top plate 73 to allow introduction of additional fluid 22, as well as for monitoring of the fluid level within the column 5. The top plate 73 is bolted to the annular ring 15 via a plurality of bolts 81, with a seal 82 positioned therebetween. The top plate 73 has a pair of apertures 83 and 84 extending therethrough, each of which is lined with a low friction insert 85, such as Teflon wiping rings or the like. The cables 64 and 65 are passed through the apertures 83 and 84, respectively, with the Teflon rings 85 providing a friction reduction, wiping and sealing function. A very light weight coil spring 86 is attached to and extends downward form the center of the column top plate 73. The spring 86 terminates in a sealing plate 91 through which extends a small bleed air orifice 92, shown in phantom lines in FIG. 4. A much more substantial coil spring 93 is attached to and extends upward from the center of the column bottom plate 14.

Each cable 64 and 65, after passing over the respective sheave 71 and 72, is then connected to the support sleeve 4 with the cables 64 and 65 connected on either side of the column 5 via a respective pair of attachment brackets 86 and 87 and a pair of terminating heads 88 and 89. Each of the cables 64 and 65 thus connect the support sleeve 4 with the piston-counterweight 23 such that, as the piston-counterweight 23 moves up in the column 5, the sleeve 4 and the connected escape platform 2 move down the outside of the column 5.

Figure 7:
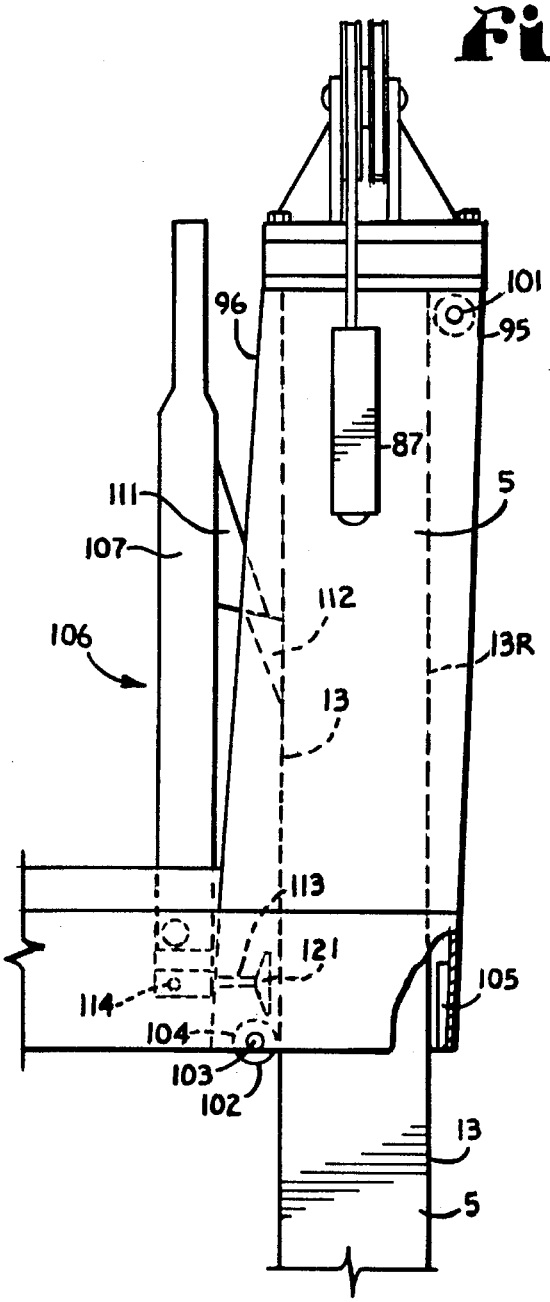
FIG. 7 is an enlarged, fragmentary, partially schematic side elevational view of the support sleeve with a hand brake handle and a hand brake pad illustrated in phantom lines in a non-operative position and with portions broken away to illustrate a friction pad opposite the hand brake pad and an upper roller spool.
Figure 8:
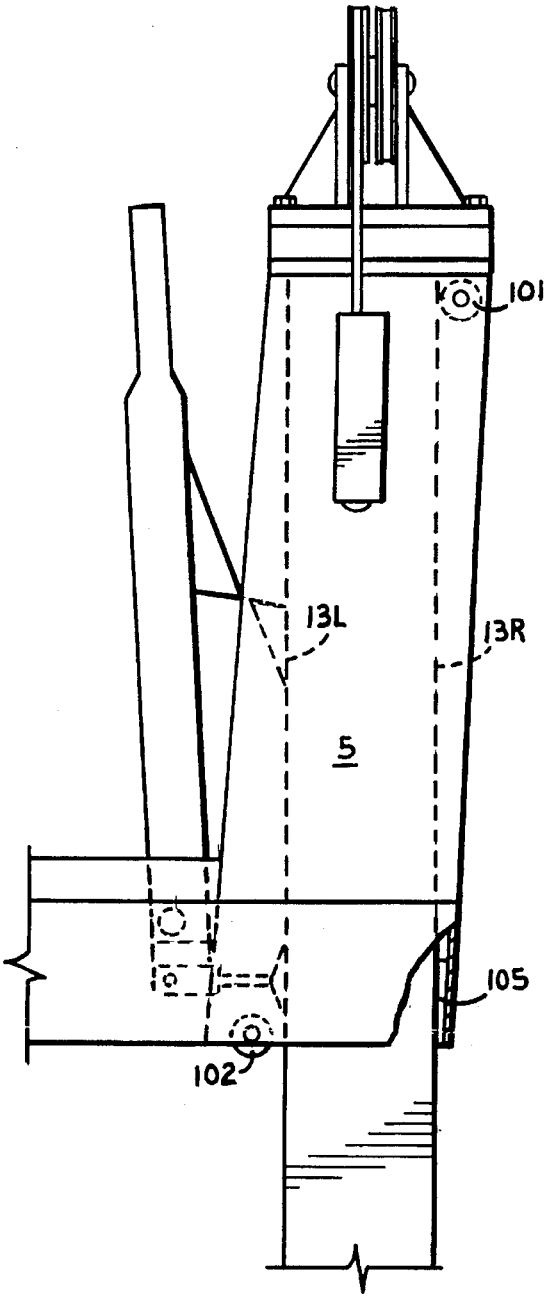
FIG. 8 is an enlarged, fragmentary, partially schematic side elevational view of the support sleeve with a hand brake handle and a hand brake pad illustrated in phantom lines in an operative position and with portions broken away to illustrate a friction pad opposite the hand brake pad in engagement with the column exterior.

Referring to FIGS. 7 and 8, the sleeve 4 is shown, partially schematically from a side elevational view. As illustrated, the sleeve 4 has a cross-sectional shape which is approximately trapezoidal. A pair of angled sidewalls 95 and 96 are attached beneath the ledge 94. The sidewall 95 extends downward at an angle toward the column 5 while the sidewall 96 extends downward at an angle away front the column 5. A pair of roller spools 101 and 102 are positioned between the sidewalls 95 and 96 and the respective column sidewalls 13R and 13L. Each of the spools 101 and 102 include a cylindrical center portion 103 with a pair of concentric, larger cylindrical end portions 104. This design, along with the angled sidewalls 95 and 96 of the sleeve 4, allow the sleeve 4 to ride over the column sidewalls 13 even if they are coated with a layer of ice. At the same time, when the column 5 is anchored in the ground below the frost line, ground source heat acts to heat the liquid 22 within the column 5 to provide an anti-icing function for the column 5.

A stationary, friction plate 105 is attached to the sidewall 95 and is positioned adjacent the right column sidewall 13R. Meanwhile, a hand brake assembly, generally indicated at 106, is attached to the sidewall 96. The hand brake assembly 106 includes a handle 107 pivotably attached to the sidewall 96 which handle 107 extends upward between the platform 2 and the column 5, with the handle 107 being readily accessible by an occupant of the escape platform 2. Attached to the handle 107 is an inwardly extending latch arm 111 which is positioned to engage a latch detent 112 (shown in phantom lines) attached to the left sidewall 13L of the column 5. Also attached to the handle 107 is a spring loaded brake piston 113 via a pivot pin 114. The brake piston 113 extends inward from the brake handle 107 and terminates in a brake friction plate 121 which is disposed adjacent the left sidewall 13L of the column 5. When the top of the handle 107 is pulled away from the column sidewall 13L, the brake friction pad 121 is urged against the spring action and into contact with the column sidewall 13L. By placing additional pressure outward on the handle 107, the brake friction pad 121 actually skews the sleeve 4, as shown in FIG. 8, thus forcing the stationary friction pad 105 into engagement with the opposite sidewall 13R. The action of the skewed sleeve 4 and the two friction pads 105 and 121 on the column 5 provide an effective braking action for the sleeve 4, and thus the platform 2.

In operation, should any occupant of the multi-story structure 11 need to escape due to fire or other emergency or due to a power outage which disables an interior elevator or the like, the occupant would enter the escape platform 2 via the deck 12. Once on the escape platform 2, the occupant would pull the brake handle 107 to the right, as shown in FIGS. 7 and 8, thus releasing the latch arm 111 from engagement with the latch detent 112. The escape platform 2 is thus freed to descend under the weight of the occupant or occupants. As the escape platform 2 descends, the connected piston-counterweight 23 ascends within the column 5, the liquid 22 within the column 4 urges the valve member 46 downward to the position indicated in FIG. 5. In this position, liquid 22 is forced to flow through the restricted central aperture 47 of the valve member 46 and then through the aperture 63 in the piston-counterweight 23, which further restricts the flow of liquid 22 through the piston-counterweight 23 during it ascent. This has the effect of slowing the ascent rate of the piston-counterweight 23 through the column 5, and, of course, also slows the descent of the connected escape platform 2.

At any time during the descent of the escape platform 2, an occupant, by pulling outward on the handle 107, can engage the brake friction plate 121 with the sidewall 13 of the column. This has the effect of placing a corresponding force by the friction plate 102 against the opposite sidewall 13, which causes a braking action, thus stopping or considerably slowing the descent rate of the escape platform 2.

As the escape platform nears ground level, the piston-counterweight 23 nears the top of the column 5 and thus encounters the seal plate 91 attached to the spring 86. Upward pressure on the seal plate 91 effectively seals off the grated opening 44 in the top piston-counterweight top plate 25, thus stopping the flow of liquid 22 through the piston-counterweight 23. This causes the piston-counterweight 23 to act as a self regulating shock absorber, first slowing, and then stopping the ascent of the piston-counterweight 23 near the top of the column 5. In addition to the damping action of the seal plate 91, a cushion of air 123, which can be 4 to 6 inches deep, is compressed by the now sealed piston-counterweight 23, thus allowing a soil landing for the platform 2 at ground level.

When the escape platform 2 reaches ground level, as shown in FIG. 3, the occupant(s) may conveniently depart the escape platform 2. Once relieved of the additional weight, the combined weight of the escape platform 2 and the sleeve 4 is less than the piston-counterweight 23, e.g. by approximately 50–75 lbs. The bleed orifice 92 in the seal plate 91 allows compression to bleed off through the seal plate 91, and the piston-counterweight 23 then begins to descend within the column 5. Within the piston-counterweight 23, as it descends through the column 5, the action of the fluid 22 within the column 5 forces the valve member 46 upward into the upper position of FIG. 4, thus allowing fluid 22 to flow relatively freely from the bottom of the piston-counterweight 23 to the top thereof through the central elongate aperture 63 and out of the grated opening 44. The decreased restriction to the flow of liquid 22 through the piston-counterweight 23 thus approximately offsets the weight differential effect of occupants on the platform 2 during its descent. Consequently, the escape platform 2 returns to the top of the column 2 at a rate approximately equal to the rate at which it travels during descent.

Once the escape platform 2 reaches the top of its ascent, the latch arm 111, due to the action of the spring loaded piston 113, latches above the latch detent 112 to hold the escape platform 2 in the position shown in FIG. 2.

In one embodiment of the invention, the roller spools 101 and 102 were 1" in diameter in the center section 103 and 2" in diameter at the end portions 104. This allows the sleeve 4 to transit coatings of ice up to ½" on the column 5. The spring 86 was approximately 14"–16" long when extended, thus providing a sealing effect at this level as the piston-counterweight 23 ascends. The platform 2 was approximately 3' by 4', which is of a size which readily accommodates a standard wheelchair. The apparatus 1 was designed to safely operate with an added weight of up to 600 lbs. on the platform 2. The valve member 46 was approximately ¾" in diameter at the top, and the central orifice 47 therethrough was approximately ¼" in diameter. The column 5 can be sized from 4" to 6" in width and depth, depending upon the height needed and weight to be accommodated. In an installation in the midwest United States, the column 5 was placed into the ground below a depth of 36".

It is to be understood that while certain forms of the present invention, including dimensions and materials, have been illustrated and described herein, it is not to be limited to the specific forms or arrangement of parts described and shown.

What is claimed and desired to be secured by Letters Patent is as follows:

1. An escape apparatus comprising:

a. a vertically oriented support column at least partially filled with liquid;

b. an escape platform;

c. a sleeve for connecting said escape platform to said support column such that said escape platform is supported by and is vertically movable relative to said support column between a raised position and a lowered position;

d. a piston-counterweight positioned within and being vertically movable relative to said column, said piston-counterweight including:

i. a piston which is smaller in cross-section than the interior of said column, said piston including an aperture which extends from the top to the bottom thereof to allow the passage of said liquid therethrough; and ii. a weight sufficient to make said piston-counterweight heavier than the combined weight of said escape platform and sleeve when said platform is empty; and e. at least one cable connected at one end to said piston-counterweight and at an opposite end to said sleeve means.

2. An escape apparatus as in claim 1, wherein said aperture in said piston-counterweight includes a recess with a frusto-conical shape, said piston-counterweight further comprising:

a. a top plate positioned over said frusto-conically shaped recess portion with a top opening extending therethrough;

b. a valve member which is frusto-conical in shape and which includes a valve aperture extending from the top to the bottom thereof, said valve aperture being smaller in diameter than said piston-counterweight aperture, and being aligned with the center of said frusto-conical recess portion, said valve member being movable within said frusto-conical aperture portion between an upper, open position when said piston-counterweight is descending within said column, and a lower, partially closed position in which it is seated on the sidewalls of said frusto-conical recess when said piston-counterweight is ascending within said column.

3. An escape apparatus as in claim 1, and further comprising:

a. a spring positioned within and near the bottom of said column to provide a cushion for said piston-counterweight as said escape platform nears the raised position.

4. An escape apparatus as in claim 1, and further comprising:

a. a light weight spring means positioned within and near the top of said column;

b. a sealing member carried by said light weight spring means, said sealing member being positioned to engage the top opening in said top plate of said piston-counterweight as said piston-counterweight encounters said spring means, said sealing member closing off said aperture such that said piston-counterweight acts as a shock absorber as said piston-counterweight approaches the top of said column.

5. An escape apparatus as in claim 4, and further comprising:

a. a bleed air orifice within said sealing member.

6. An escape apparatus as in claim 1, wherein said column is rectangular in cross-section, said sleeve means comprising:

a. two pairs of opposing side walls with tops connected to said escape platform, with a respective one of said sidewalls positioned adjacent each exterior side of said column; and b. first and second roller means positioned between respective first and second ones of said sidewalls and said column.

7. An escape apparatus as in claim 6, wherein said first one of said sidewalls is angled toward the respective sidewall from top to bottom while said second one of said sidewalls opposite said first sidewall is angled away from the respective column sidewall from top to bottom such that said sleeve means presents a trapezoidal shape in cross-section.

8. An escape apparatus as in claim 6, wherein said first and second roller means each comprise:

a. a roller spool with a cylindrical center portion and a pair of concentric cylindrical end portions, each of which is larger in diameter than said center section.

9. An escape apparatus as in claim 6, and further comprising:

a. hand brake means for braking the descent of said escape platform relative to said column.

10. An escape apparatus as in claim 9, wherein said hand brake means comprises:

a. a handle extending upwards from said sleeve means with a bottom handle portion being pivotably connected to said sleeve means at a pivot point and a top handle portion being accessible from said escape platform such that said top portion is selectively movable toward and away from said column;

b. a braking friction pad attached to said bottom portion of said handle near said pivot point, said braking friction plate being movable into contact with an exterior surface of said column when said top handle portion is moved away from said column.

11. An escape apparatus as in claim 10, wherein said brake means further comprises a stationary friction plate positioned approximately opposite said braking friction plate, said stationary friction plate being attached to said sleeve means whereby when said top handle portion is moved away from said column, said sleeve is skewed such that said stationary friction plate is moved into contact with said column opposite said braking friction plate.

12. An escape apparatus as in claim 10, wherein said brake means further comprises a latch arm connected to said handle above said pivot point, said latch arm cooperating with a latch detent on said exterior surface of said column to hold said sleeve means, and said escape platform, in a latched position with respect to said column, said latch arm being released from said latch detent when said handle is moved away from said column to allow said sleeve means to move relative to said column.

13. An escape apparatus comprising:

a. a vertically oriented support column at least partially filled with liquid;

b. an escape platform;

c. sleeve means for connecting said escape platform to said support column such that said escape platform is supported by and is vertically movable relative to said support column between a raised position and a lowered position;

d. a piston-counterweight positioned within and being vertically movable relative to said column, said piston-counterweight comprising:

i. a piston which is smaller in cross-section than the interior of said column, said piston including an aperture which extends from the top to the bottom thereof;

ii. sealing means for sealing said piston against the interior sidewalls of said column; and iii. a weight sufficient to make said piston-counterweight heavier than said escape platform when empty; and e. at least one cable connected at one end to said piston-counterweight and at an opposite end to said sleeve means.

14. An escape apparatus as in claim 13, wherein said aperture in said piston-counterweight includes a recess with a frusto-conical shape, said piston-counterweight further comprising:

a. a top plate positioned over said frusto-conically shaped recess portion with at least top opening extending therethrough;

b. a valve member which is frusto-conical in shape and which includes a valve aperture extending from the top to the bottom thereof, said valve aperture being smaller in diameter than said piston-counterweight aperture, and being aligned with the center of said frusto-conical recess portion, said valve member being movable within said frusto-conical aperture portion between an upper, open position when said piston-counterweight is descending within said column, and a lower, partially closed position in which it is seated on the sidewalls of said frusto-conical recess when said piston-counterweight is ascending within said column.

15. An escape apparatus as in claim 13, and further comprising:

a. a spring positioned within and near the bottom of said column to provide a cushion for said piston-counterweight as said escape platform nears the raised position.

16. An escape apparatus as in claim 13, and further comprising:

a. a light weight spring means positioned within and near the top of said column;

b. a sealing member carried by said light weight spring means, said sealing member being positioned to engage the top opening in said top plate of said piston-counterweight as said piston-counterweight encounters said spring means, said sealing member closing off said aperture such that said piston-counterweight acts as a shock absorber as said piston-counterweight approaches the top of said column; and c. a bleed air orifice within said sealing member.

17. An escape apparatus as in claim 13, wherein said column is rectangular in cross-section, said sleeve means comprising:

a. two pairs of opposing side walls, with a respective one of said sidewalls positioned adjacent each exterior side of said column, a first one of said sidewalls being angled toward the respective sidewall from top to bottom while said second one of said sidewalls opposite said first sidewall being angled away from the respective column sidewall from top to bottom such that said sleeve means presents an approximately trapezoidal shape in cross-section; and b. respective first and second roller means positioned between said first and second ones of said sidewalls and said column.

18. An escape apparatus as in claim 17, wherein said first and second roller means each comprise:

a. a roller spool with a cylindrical center portion and a pair of concentric cylindrical end portions, each of which is larger in diameter than said center section.

19. An escape apparatus as in claim 13, and further comprising:

a. hand brake means for braking the descent of said escape platform relative to said column.

20. An escape apparatus as in claim 19, wherein said hand brake means comprises:

a. a handle extending upwards from said sleeve means with a bottom handle portion being pivotably connected to said sleeve means at a pivot point and a top handle portion being accessible from said escape platform such that said top portion is selectively movable toward and away from said column;

b. a braking friction pad attached to said bottom portion of said handle near said pivot point, said braking friction plate being movable into contact with an exterior surface of said column when said top handle portion is moved away from said column.

21. An escape apparatus as in claim 20, wherein said brake means further comprises a stationary friction plate positioned approximately opposite said braking friction plate, said stationary friction plate being attached to said sleeve means whereby when said top handle portion is moved away from said column, said sleeve is skewed such that said stationary friction plate is moved into contact with said column opposite said braking friction plate.

22. An escape apparatus as in claim 20, wherein said brake means further comprises a latch arm connected to said handle above said pivot point, said latch arm cooperating with a latch detent on said exterior surface of said column to hold said sleeve means, and said escape platform, in a latched position with respect to said column, said latch arm being released from said latch detent when said handle is moved away from said column to allow said sleeve means to move relative to said column.

23. An escape apparatus comprising:

a. a substantially vertically oriented support column at least partially filled with liquid;

b. an escape platform connected to said column such that it is movable vertically relative to said platform;

c. a piston-counterweight positioned within and being vertically movable relative to said column, said piston-counterweight including:

i. a piston which is smaller in cross-section than the interior of said column, said piston including an aperture which extends from the top to the bottom thereof to allow the passage of said liquid therethrough, said aperture including a recess with a frusto-conical shape;

ii. a weight sufficient to make said piston-counterweight heavier than the weight of said escape platform when said platform is empty;

iii. a top plate positioned over said frusto-conically shaped recess with a top opening extending therethrough; and iv. a valve member which is frusto-conical in shape and which includes a valve aperture extending from the top to the bottom thereof, said valve aperture being smaller in diameter than said piston-counterweight aperture, and being aligned with the center of said frusto-conical recess portion, said valve member being movable within said frustoconical aperture portion between an upper, open position when said piston-counterweight is descending within said column, and a lower, partially closed position in which it is seated on the sidewalls of said frusto-conical recess when said piston-counterweight is ascending within said column; and d. at least one cable connected at one end to said piston-counterweight and at an opposite end to said platform.

* * * * *